US008025290B2

(12) United States Patent
Kajita

(10) Patent No.: US 8,025,290 B2
(45) Date of Patent: Sep. 27, 2011

(54) IMAGE FORMING DEVICE AND A COMBINATION OF A FIXING DEVICE AND A SHEET JAMMING DETERMINATION DEVICE

(75) Inventor: Masahito Kajita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 120 days.

(21) Appl. No.: 12/604,957

(22) Filed: Oct. 23, 2009

(65) Prior Publication Data

US 2010/0109232 A1 May 6, 2010

(30) Foreign Application Priority Data

Oct. 30, 2008 (JP) ..... 2008-280112

(51) Int. Cl.
*B65H 7/02* (2006.01)

(52) U.S. Cl. ..... 271/259; 271/258.04; 271/265.02; 271/274; 399/406

(58) Field of Classification Search ..... 271/259, 271/258.04, 265.02, 273, 274; 399/397, 399/400, 406

See application file for complete search history.

(56) References Cited

U.S. PATENT DOCUMENTS

| | | | | |
|---|---|---|---|---|
| 4,980,717 | A * | 12/1990 | Kiguchi | 355/50 |
| 5,937,258 | A * | 8/1999 | Acquaviva et al. | 399/341 |
| 2008/0131177 | A1 | 6/2008 | Aratachi et al. | |
| 2009/0257801 | A1 * | 10/2009 | Miyoshi et al. | 399/406 |

FOREIGN PATENT DOCUMENTS

| | | |
|---|---|---|
| JP | 07-048046 | 2/1995 |
| JP | 2008-158507 | 7/2008 |

* cited by examiner

*Primary Examiner* — Michael C McCullough
(74) *Attorney, Agent, or Firm* — Banner & Witcoff, Ltd.

(57) ABSTRACT

An image forming device including a pair of fixing rollers, a sheet guide unit displaceable to one of first and second positions, a position detector detecting a position of the sheet guide unit, first and second sheet sensors respectively detecting the sheet at a first fixed position upstream of the fixing rollers and at a second fixed position downstream of the fixing rollers, and a control unit including a determination unit and a determination part. The determination unit includes a retrieving part that retrieves first and second threshold time periods when the position detector detects the first and second positions, respectively. The determination part determines whether a first or second time period starting from detecting by the first sheet sensor and ending when detecting by the second sheet sensor are within the first and second threshold time periods, respectively, when the position detector detects the first and second positions, respectively.

19 Claims, 5 Drawing Sheets

IMAGE FORMING DEVICE AND A COMBINATION OF A FIXING DEVICE AND A SHEET JAMMING DETERMINATION DEVICE

CROSS REFERENCE TO RELATED APPLICATION

This application claims priority from Japanese Patent Application No. 2008-280112 filed Oct. 30, 2008. The entire content of the priority application is incorporated herein by reference.

TECHNICAL FIELD

The present invention relates to an image forming device such as a laser printer.

BACKGROUND

The laser printer includes a fixing device for fixing a toner image to a sheet. The fixing device includes a heat roller and a pressure roller in pressure contact therewith. A sheet on which a toner image has been transferred is conveyed to pass between the heat roller and the pressure roller, whereupon the toner image is fixed to the sheet under heat and pressure. The image fixed sheet is then discharged to a sheet discharge portion through a pair of conveyer rollers.

Due to the application of heat to the sheet, the image fixed sheet may be curled in conformance with an outer peripheral surface of the heat roller. The curl may cause sheet jamming or disarray on the sheet discharge portion. In order to avoid sheet curling, a mechanism for changing a sheet nip position by the pair of conveyer rollers has been proposed. More specifically, a lever is pivotally movably provided about an axis of a rotation shaft of one of the conveyer rollers, and the lever supports the other conveyer roller. By the operation of the lever, the nip position between the pair of conveyer rollers can be changed taking a curling state of the sheet into consideration.

Further, in the printer, a first sheet sensor is provided at an upstream side of the fixing device, and a second sheet sensor is provided at a downstream side thereof in order to detect a passing of the sheet. Determination falls "sheet jamming" in case of a non-detection of the sheet at the second sensor within a predetermined time period starting from the detection timing of the sheet at the first sensor.

SUMMARY

If the nip position changing mechanism and the sheet sensors are co-used, determination of sheet jamming may not be precisely performed, since sheet passageway between the fixing device and the pair of conveyer rollers is changed due to the change in the nip position of the pair of conveyer rollers. Detection timing at the second sensor may be varied due to the change in passageway. Accordingly, erroneous determination of sheet jamming occurs in spite of no occurrence of sheet jamming, or determination of sheet jamming may be delayed to cause winding of the sheet over the heat roller or pressure roller.

In view of the foregoing, it is an object of the invention to provide an image forming device capable of precisely determining sheet jamming even if the sheet passageway staring from the fixing device is changed.

This and other objects of the invention will be attained by providing an image forming device including a sheet conveying unit, a pair of fixing rollers, a sheet guide unit, a position detector, a first sheet sensor, a second sheet sensor, and a control unit. The sheet conveying unit is configured to convey a sheet in a sheet feeding direction. The pair of fixing rollers nips the sheet fed from the sheet conveying unit to fix a visible image onto the sheet. Each of the pair of fixing rollers having a roller axis. The sheet guide unit is displaceable to one of a first position and a second position to guide a travel of the sheet fed from the pair of the fixing rollers and to change a locus of the sheet toward a downstream side of the pair of the fixing rollers. The first position and the second position are remote from each other in a direction intersecting with the roller axis. The position detector is configured to detect a position of the sheet guide unit. The first sheet sensor detects passing of the sheet at a first fixed position upstream of the pair of fixing rollers in the sheet feeding direction. The second sheet sensor detects arrival of the sheet at a second fixed position downstream of the pair of fixing rollers in the sheet feeding direction. The position detector, the first sheet sensor and the second sheet sensor are connected to the control unit. The control unit includes a determination unit including a retrieving part, and a determination part. The retrieving part retrieves a first threshold time period when the position detector detects the first position of the sheet guide unit, or retrieves a second threshold time period different from the first threshold time period when the position detector detects the second position of the sheet guide unit. The determination part determines whether or not a first time period starting from a timing of detection by the first sheet sensor and ending at a timing of detection by the second sheet sensor is within the first threshold time period when the position detector detects the first position, or determines whether or not a second time period starting from a timing of detection by the first sheet sensor and ending at a timing of detection by the second sheet sensor is within the second threshold time period when the position detector detects the second position.

In another aspect of the invention, there is provided a combination of a fixing device and a sheet jamming determination device. The fixing device includes a frame, a pair of conveyer rollers, a pair of fixing rollers, a lower holding member, an upper holding member, and a sheet guide section. The pair of conveyer rollers includes an upper roller and a lower roller. The pair of fixing rollers are rotatably supported to the frame, and are positioned upstream of the pair of conveyer roller in a sheet feeding direction. The lower holding member is vertically movably supported to the frame and rotatably supports the lower roller. The upper holding member is pivotally movably supported to the frame and is movable to either one of a first position and a second position in synchronism with the movement of the lower holding member. The upper holding member rotatably supports the upper roller maintaining a contact of the upper roller with the lower roller. The sheet guide section has an upstream end portion pivotally movable relative to the frame and a downstream end portion pivotally movable about an axis of the upper roller to change a posture of the sheet guide section. The sheet jamming determination device includes a position detector, a first sheet sensor, a second sheet sensor, and a control unit. The position detector is configured to detect a position of the upper holding member. The first sheet sensor detects passing of the sheet at a first fixed position upstream of the pair of fixing rollers in the sheet feeding direction. The second sheet sensor detects arrival of the sheet at a second fixed position downstream of the pair of fixing rollers in the sheet feeding direction. The position detector, the first sheet sensor and the second sheet sensor are connected to the control unit. The control unit includes a determination unit including a retrieving part and a determination part. The retrieving part retrieves a first threshold time period when the position detector detects the first position of the upper holding member, or retrieves a second threshold time period different from the first threshold time period when the position detector detects the second position of the upper holding member. The determination part determines whether or not a first time period starting from a timing of detection by the first sheet sensor and ending at a timing of detection by the second sheet sensor is within the first threshold time period when the position detector detects the first position, or determines whether or not a second time period starting from a timing of detection by the first sheet sensor and ending at a timing of detection by the second sheet sensor is within the second threshold time period when the position detector detects the second position.

DETAILED DESCRIPTION

Figure 1:
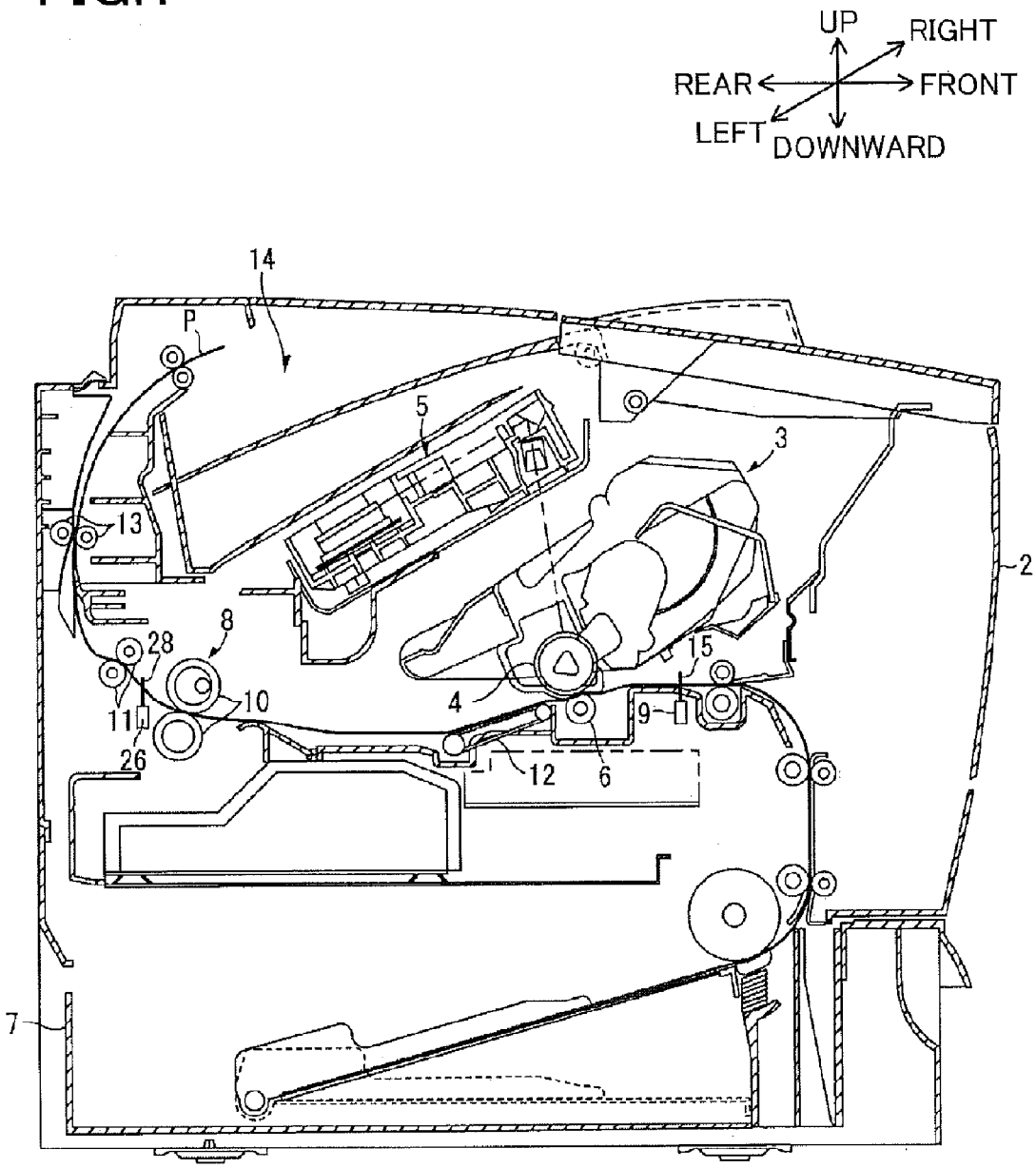
FIG. 1 is a cross-sectional side view of a laser printer according to one embodiment of the invention.
Figure 2:
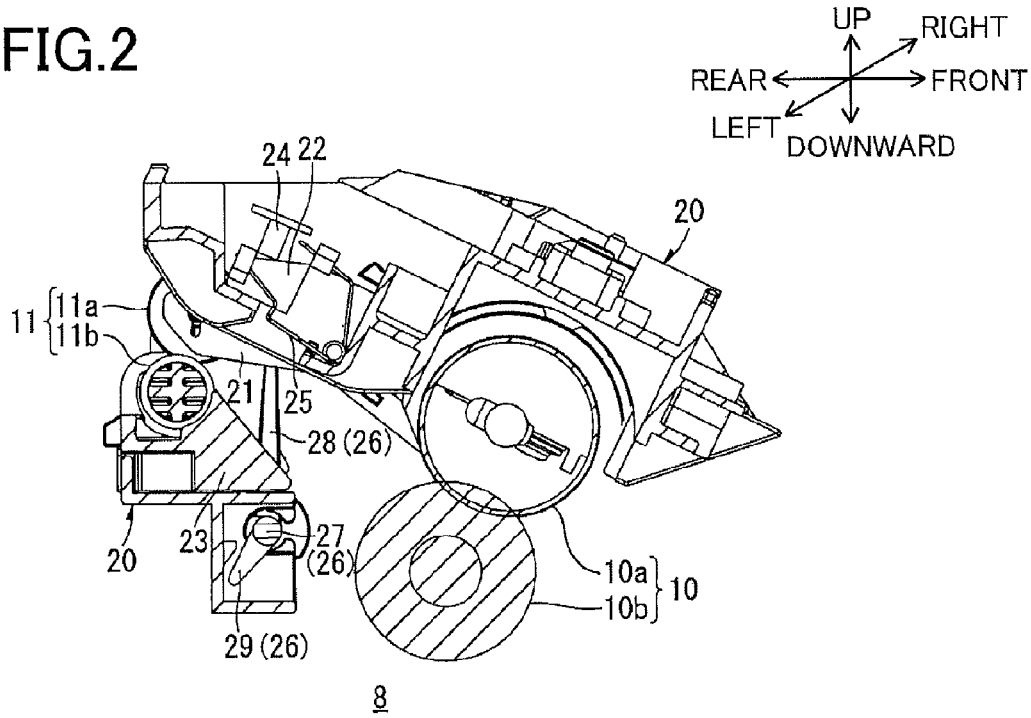
FIG. 2 is a cross-sectional view of a fixing device and a pair of conveyer rollers in the laser printer according to the embodiment and showing a first position of the pair of conveyer rollers.
Figure 3:
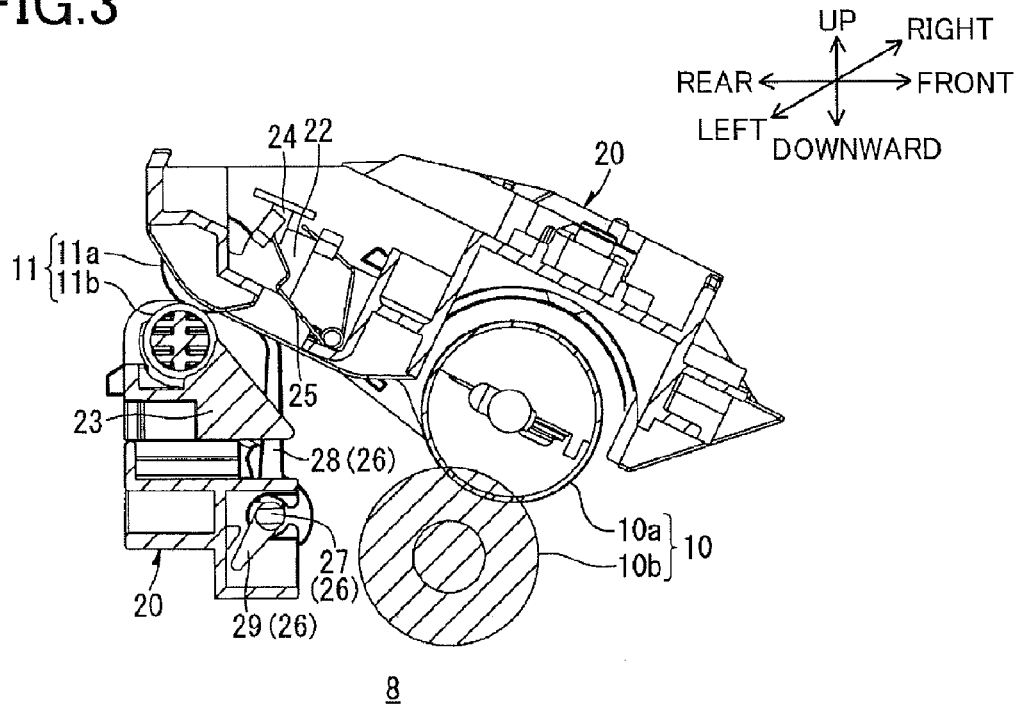
FIG. 3 is a cross-sectional view of the fixing device and the pair of conveyer rollers in the laser printer according to the embodiment and showing a second position of the pair of conveyer rollers.

An image forming device according to one embodiment of the invention will be described with reference to FIGS. 1 through 6. The embodiment pertains to a laser printer 1. Throughout the specification, the terms "upward", "downward", "upper", "lower", "above", "below", "beneath", "right", "left", "front", "rear" and the like will be used assuming that the laser printer is disposed in an orientation in which it is intended to be used.

The laser printer 1 includes an outer casing 2 in which a process cartridge 3 having a photosensitive drum 4 and a developing roller (not shown) is disposed. An exposure unit 5 is provided above the process cartridge 3 and is adapted to emit laser beam so as to form an electrostatic latent image on an outer peripheral surface of the photosensitive drum 4 during rotation thereof. The developing roller is adapted for supplying toner to the photosensitive drum to form a visible toner image corresponding to the electrostatic latent image. A transfer roller 6 is provided in direct confrontation with the photosensitive drum 4. A transfer bias is applied to the transfer roller 6.

A sheet cassette 7 is provided at a bottom portion of the outer casing 2 for accommodating therein a stack of sheets P. Each sheet P is supplied from the sheet cassette 7 and passes between the photosensitive drum 4 and the transfer roller 6, so that the toner image on the photosensitive drum can be transferred onto the sheet by the transfer bias.

A fixing unit 8 is provided at a position downstream of the process cartridge 3 in a sheet feeding direction. The fixing unit 8 includes a pair of fixing rollers 10, and a pair of conveyer rollers 11 positioned downstream of the pair of fixing rollers 10.

An endless belt 12 is positioned between the process cartridge 3 and the fixing unit 8 for conveying the sheet P bearing the toner image to the fixing unit 8. A pair of discharge rollers 13 is provided downstream of the pair of conveyer rollers 11, and a discharge tray 14 is defined at an upper surface of the outer casing 2. The pair of fixing rollers 10 is adapted to apply heat and pressure to the sheet P when the sheet passes through the rollers 10 to thus fix the toner image to the sheet P. The sheet P is then discharged onto the discharge tray 14 through the discharge rollers 13.

A first sheet sensor 9 is provided upstream of the transfer roller 6 to detect passing of the sheet P. The sheet sensor 9 is provided with an actuator 15 protruding across a sheet passage. A leading edge of the sheet P directing toward a nipping portion defined between the photosensitive drum 4 and the transfer roller 6 is brought into abutment with the actuator 15 whereupon sheet passing can be detected.

A second sheet sensor 26 is provided at a position between the pair of fixing rollers 10 and the pair of conveyor rollers 11 to detect passing of the sheet P. The sheet sensor 26 is provided with an actuator 28 protruding across a sheet passage. The leading edge of the sheet P directing from the pair of fixing rollers 10 to the pair of conveyor rollers 11 is brought into abutment with the actuator 28 whereupon sheet passing can be detected.

Details of the fixing unit 8 will next be described. The fixing unit 8 includes a frame 20 supporting the pair of fixing rollers 10 and the pair of conveyer rollers 11. The pair of fixing rollers 10 includes a heat roller 10*a* in which a heater is accommodated and a pressure roller 10*b* positioned below and rearward of the heat roller 10 and in pressure contact therewith. The pair of conveyer rollers 11 includes an upper roller 11*a* and a lower roller 11*b* in contact with the upper roller 11*a* from below. The frame 20 supports a sheet guide section 21, an upper holding segment 22, a lower holding segment 23, a photo-sensor 24, a biasing member such as a torsion spring 25, and the second sheet sensor 26.

The upper holding segment 22 is vertically movably supported to the frame 20, and rotatably supports the upper roller 11*a*. More specifically, the upper holding segment 22 is pivotally movable in the vertical direction about an axis extending parallel to a rotation axis of the heat roller 10*a* between a first position (lower position) shown in FIG. 2 and a second position (upper position) shown in FIG. 3. Thus, the upper roller 11*a* is movable between the first and second positions.

The lower holding segment 23 is vertically movably supported to the frame 20, and rotatably supports the lower roller 11*b*. More specifically, the lower holding segment 23 is slidably movable in the vertical direction between the first position and the second position. Thus, the lower roller 11*b* is movable between the first and second positions. One of the upper and lower positions can be selected when an operator manipulates a manipulating portion (not shown).

The torsion spring 25 has a V-shaped configuration having a center fulcrum point and free ends biased in a direction away from each other. One of the free ends and the fulcrum point are engaged with the frame 20. The other free end is positioned lower than the one of the free ends, and is engaged with the upper holding segment 22. Thus, the upper roller 11*a* is urged downward by the biasing force of the torsion spring 25. In other words, the upper roller 11*a* is urged toward the lower roller 11*b* by the torsion spring 25. Therefore, a pressure contact of upper roller 11*a* onto the lower roller 11*b* can be maintained even by the movement of the upper roller 11*a* between the first position and the second position, to ensure nipping and conveying of the sheet P toward downstream side of the pair of conveyer rollers 11 regardless of the position of the pair of conveyer rollers 11.

The photo-sensor 24 is fixed to the frame 20 at a position close to the upper holding segment 22, and includes a light emitting element and a light receiving element defining an optical path. The light emitting element is spaced away from the light receiving element in a widthwise direction of the sheet P, the widthwise direction being perpendicular to the sheet feeding direction. A part of the upper holding segment 22 is positioned offset from the optical path when the upper holding segment 22 is at the first position shown in FIG. 2. In this case, light emitted from the light emitting element can be received by the light receiving element outputting ON signal from the light receiving element. On the other hand, the part of the upper holding segment 22 is positioned on the optical path when the upper holding segment 22 is at the second position shown in FIG. 3. In this case, light emitted from the light emitting element is shut off, outputting OFF signal from the light receiving element. Thus, position of the pair of conveyer rollers 11, either at the first position or the second position, can be detected based on the signal from the photo-sensor 24.

The sheet guide section 21 extends in a frontward/rearward direction, and has a front end portion movably connected relative to the frame 20, and a rear end portion pivotally movable about a shaft of the upper roller 11*a*. In other words, a sheet passage between a nip point defined by the fixing rollers 10 and a nip point defined by the conveyer rollers 11 can be changed in accordance with the vertical movement of the upper roller 11*a*, and a posture of the sheet guide section 21 is changeable in accordance with the vertical movement of the upper roller 11*a*, so that a lower edge of the sheet guide section 21 can be aligned with the sheet passage. Consequently, the sheet P fed out of the fixing rollers 10 is guided by the sheet guide section 21, and can be entered into the nip point defined between the conveyer rollers 11. In other words, the sheet guide section 21 and the conveyer rollers 11 are co-operated to function as a sheet guide mechanism for feeding the sheet P toward a downstream region.

The second sheet sensor 26 includes a support shaft 27, the actuator 28, and a switching segment 29. The support shaft 27 is rotatably supported to the frame 20, and extends in a lateral direction (widthwise direction of the sheet). The actuator 28 extends upward from the support shaft 27 along an imaginary predetermined plane intersecting with the sheet passage. The switching segment 29 extends from the support shaft 27 in a direction opposite to the extending direction of the actuator 28. When the sheet P is conveyed along the sheet passage, the leading edge of the sheet P is brought into abutment with the actuator 28, so that the actuator 28 is pivotally moved rearward about an axis of the support shaft 27. At the same time, the switching segment 29 is also pivotally moved about the axis to turn ON a switch (not shown). Thus, ON signal is outputted from the second sheet sensor 26. Based on the ON signal, arrival of the sheet P at the predetermined imaginary plane can be detected. The position of the second sheet sensor 26 relative to the pair of fixing rollers 10 is fixed. That is, position of the second sheet sensor 26 is not changed irrespective of the displacement of the pair of conveyer rollers 11. Thus stabilized sheet detection is achievable at the second sheet sensor 26.

Next, sheet curling control or correction will be described. Sheet curling is classified into a forward curling in which a curvature of the curled sheet is in conformance with the outer peripheral surface of the heat roller 10*a*, and reverse curling in which a curvature of curled sheet is in conformance with the outer peripheral surface of the pressure roller 10*b*. When the lower roller 11*b* is maintained at its first position (lower position), the upper holding segment 22 and the upper roller 11*a* supported thereto are biased downward by the biasing force of the torsion spring 25. Therefore, the upper roller 11*a* is brought into abutment with the lower roller 11*b* at the lower position. In this state, the forward curling will be moderated or removed. That is, in the lower position, the sheet guide section 21 is directed rearward and downward, so that the leading edge of the sheet P fed from the pair of fixing rollers 10 will be directed downward, which is opposite to the forward curling direction, through guidance by the sheet guide section 21, and then will be nipped between the upper and lower rollers 11*a*, and 11*b*. Thus, the forward curling can be removed or moderated.

Upon manipulation to the manipulating portion, the lower holding segment 23 and the lower roller 10*b* supported thereto are moved upward (moved to the second position). Since the upper roller 10*a* is in abutment with the lower roller 10*b*, the upper roller 10*a* and the upper holding segment 22 are also moved upward against the biasing force of the torsion spring 25. In this state, the reverse curling will be moderated or removed. That is, in the upper position, the sheet guide section 21 is directed rearward and upward, so that the leading edge of the sheet P fed from the pair of fixing rollers 10 will be directed upward, which is opposite to the reverse curling direction, through the guidance by the sheet guide section 21, and then will be nipped between the upper and lower rollers 11*a*, and 11*b*. Thus, the reverse curling can be removed or moderated.

Figure 4:
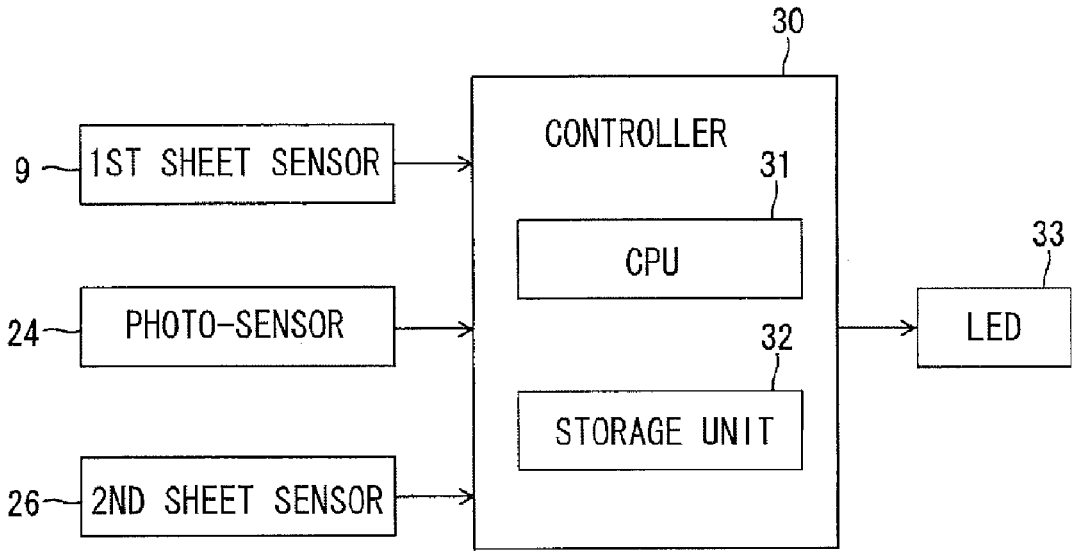
FIG. 4 is a block diagram showing an electrical connection including a controller in the laser printer according to the embodiment.

Electrical connection in the fixing unit 8 will be described with reference to FIG. 4. A controller 30 such as a microcomputer is provided. The controller 30 includes a CPU 31 executing computation and various determinations and a storage unit 32 such as a ROM. The first sheet sensor 9, the photo-sensor 24 and the second sheet sensor 26 are connected to the controller 30, so that output signals from these sensors are transmitted to the controller 30. Further, an LED 33 functioning as an alarm unit is connected to the controller 30. The ROM 32 stores therein threshold levels of first time period T1 and second time period T2. In other words, in the present embodiment, no computation is required to obtain these periods T1 and T2. Therefore, processing described later can be achieved promptly by simply retrieving the time period from the ROM 32.

Figure 5:
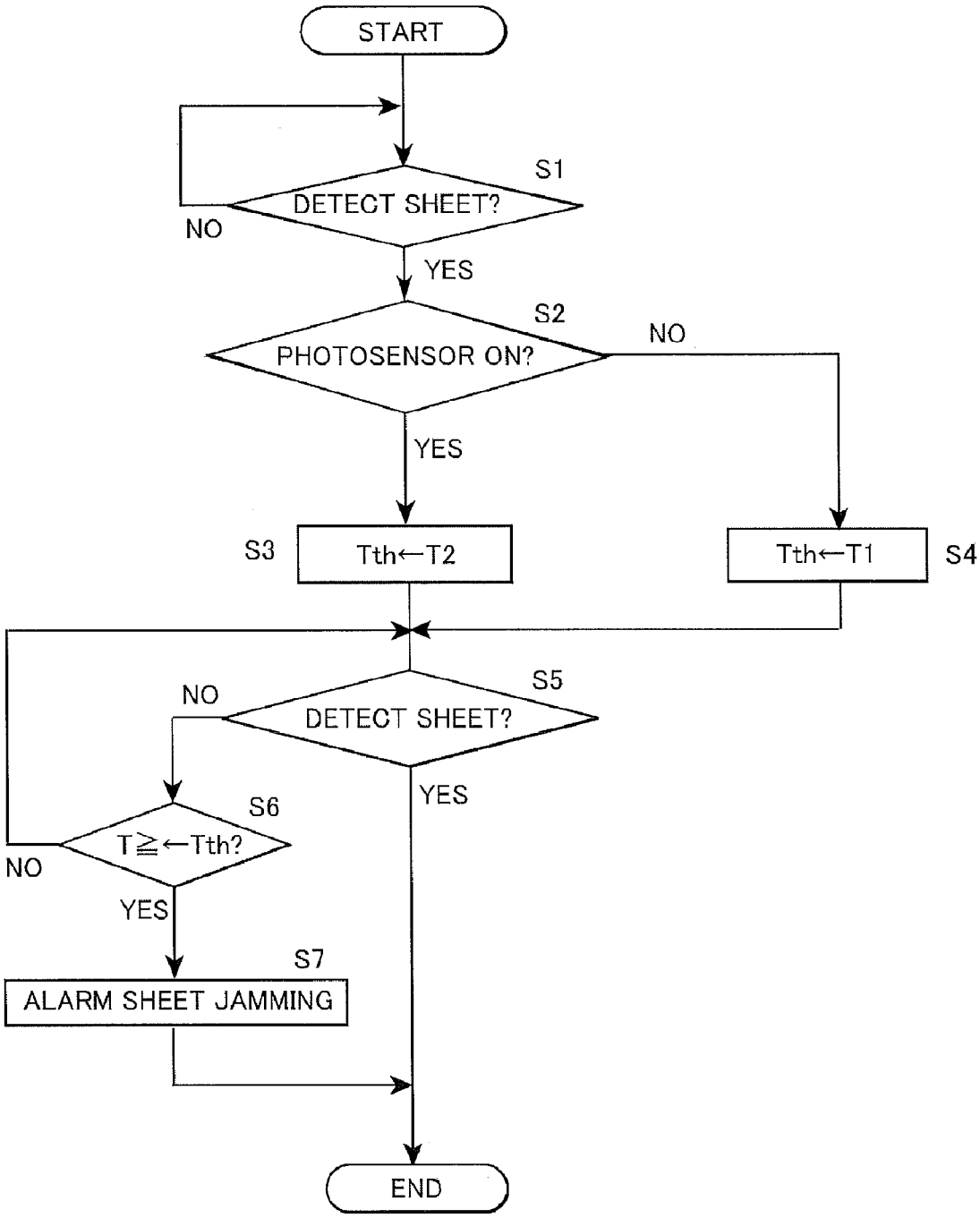
FIG. 5 is a flowchart showing a sheet jamming alarming routine in the laser printer according to the embodiment.

Sheet jam alarming routine will be described with reference to a flowchart shown in FIG. 5. After the sheet P is fed from the sheet cassette 7 for forming an image on the sheet P, the CPU 31 determines whether or not an output signal from the first sheet sensor 9 is transmitted (S1). That is, the determination is made as to whether or not the leading edge of the sheet P passes through the detecting position of the first sheet sensor 9.

If the output signal is transmitted (S1: Yes), CPU 31 determines whether or not ON signal is transmitted from the photo-sensor 24 (S2). If ON signal is transmitted (S2: Yes), determination is made in the CPU 31 that the pair of conveyer rollers 11 is at the second position. Then, a second time period "T2" stored in the storage unit 32 is retrieved as a threshold time period "Tth" (S3). On the other hand, if OFF signal is transmitted (S2: No), determination is made in the CPU 31 that the pair of conveyer rollers 11 is at the first position. Then, a first time period "T1" stored in the storage unit 32 is retrieved as a threshold time period "Tth" (S4).

Next, determination is made in the CPU 31 as to whether or not ON signal from the second sensor 26 is transmitted (S5).

If ON signal has not been transmitted (S5: No), determination is made as to whether or not an elapsed time period "T" starting from the ON timing of the first sheet sensor 9 is not less than the threshold time period "Tth" (S6). If "T" is less than "Tth" (S6: No), the routine returns to S5.

If ON signal is transmitted from the second sheet sensor 26 within the threshold time period "Tth" (S5: Yes), then the routine is ended because no sheet jamming occurs. On the other hand, if the ON signal has not been transmitted from the second sheet sensor 26 within the threshold time period "Tth" (S6: Yes), the routine proceeds to S7 where LED 33 becomes luminous thereby alarming sheet jamming to the user. Then, the processing is ended.

In this way, because of the displacement of the pair of conveyer rollers 11, conveying direction of the sheet P fed from the pair of fixing rollers 10 is changed, and a sheet conveying locus is changed. Therefore, sheet detection timing at the second sheet sensor 26 will be changed dependent on the position of the pair of conveyer rollers 11 between the first position and the second position. However, threshold level for determination of the sheet jamming can be changed between T1 and T2 dependent on the position of the pair of conveyer rollers 11. Therefore, sheet jamming can be precisely detected regardless of the position of the pair of conveyer rollers 11.

Figure 6:
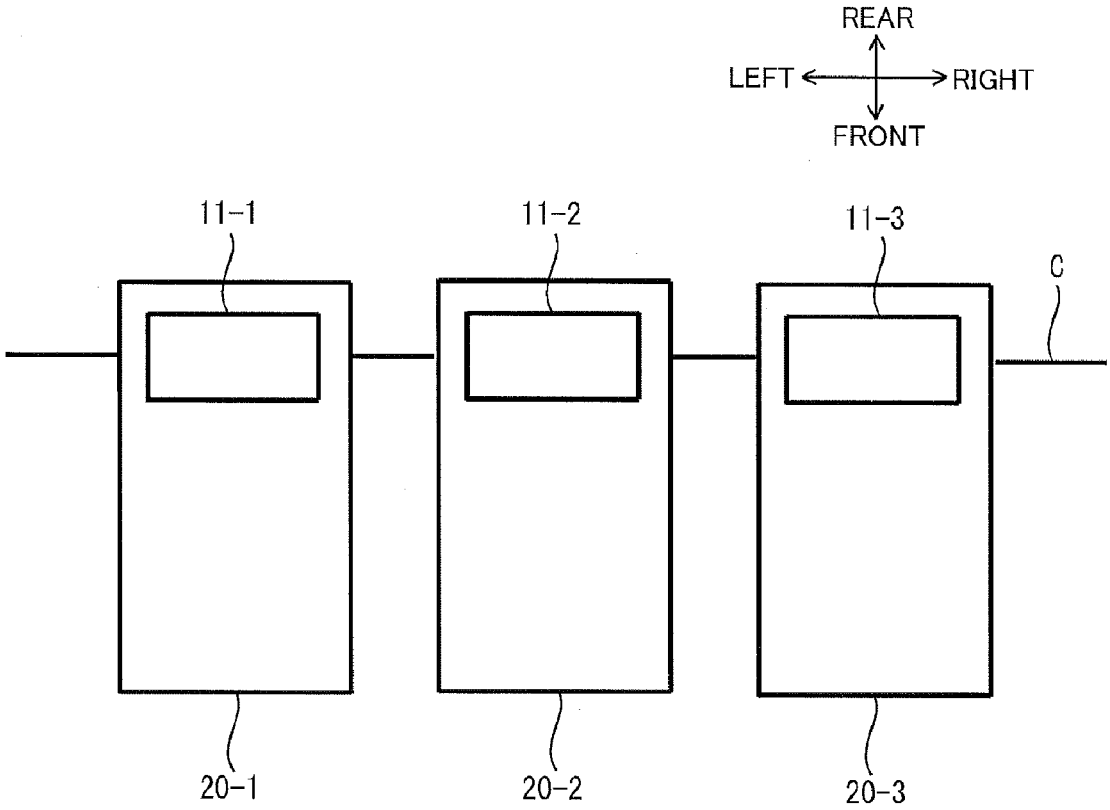
FIG. 6 is a cross-sectional view according to another embodiment of the invention.

Various modifications are conceivable. For example, each conveyer rollers 11 can be divided into a plurality of roller segments 11-1, 11-2 and 11-3 arrayed in the widthwise direction of the sheet P as shown in FIG. 6 (arrayed in a direction of a roller axis C). In the latter case, the frames 20-1, 20-2 and 20-3 can be provided corresponding to the numbers of roller segments. Thus, each pair of roller segments can be moved between the first and second position. Consequently, sheet conveying performance can be improved. This is advantageous when the sheet P is largely curled.

While the invention has been described in detail with reference to the specific embodiment thereof, it would be apparent to those skilled in the art that various changes and modifications may be made therein without departing from the spirit of the invention.

What is claimed is:

1. An image forming device comprising:

a sheet conveying unit that conveys a sheet in a sheet feeding direction;

a pair of fixing rollers that nips the sheet fed from the sheet conveying unit to fix a visible image onto the sheet, each of the pair of fixing rollers having a roller axis;

a sheet guide unit displaceable to one of a first position and a second position to guide a travel of the sheet fed from the pair of the fixing rollers and to change a locus of the sheet toward a downstream side of the pair of the fixing rollers, the first position and the second position being remote from each other in a direction intersecting with at least one of the roller axes;

a position detector that detects a position of the sheet guide unit;

a first sheet sensor that detects passing of the sheet at a first fixed position upstream of the pair of fixing rollers in the sheet feeding direction;

a second sheet sensor that detects arrival of the sheet at a second fixed position downstream of the pair of fixing rollers in the sheet feeding direction; and a control unit to which the position detector, the first sheet sensor and the second sheet sensor are connected, the control unit comprising:

a processing unit;

a non-transitory medium, having instructions stored thereon that, when executed by the processing unit, cause the control unit to function as a retrieving part that retrieves a first threshold time period when the position detector detects the first position of the sheet guide unit, or retrieves a second threshold time period different from the first threshold time period when the position detector detects the second position of the sheet guide unit; and a determination part that determines whether or not a first time period starting from a timing of detection by the first sheet sensor and ending at a timing of detection by the second sheet sensor is within the first threshold time period when the position detector detects the first position, or determines whether or not a second time period starting from a timing of detection by the first sheet sensor and ending at a timing of detection by the second sheet sensor is within the second threshold time period when the position detector detects the second position.

2. The image forming device as claimed in claim 1, wherein the control unit further comprises a storage part that stores the first threshold time period and the second threshold time period.

3. The image forming device as claimed in claim 1, wherein the sheet guide unit comprises a pair of conveyer rollers that nips and conveys the sheet in the sheet feeding direction.

4. The image forming device as claimed in claim 3, wherein the sheet guide unit further comprises a sheet guide section extending between the pair of fixing rollers and the pair of conveyer rollers for guiding travel of the sheet fed from the pair of fixing rollers toward the pair of conveyer rollers.

5. The image forming device as claimed in claim 3, further comprising a holding member supporting one of the pair of conveyer rollers and moving the one of the pair of conveyer rollers to either one of the first position and the second position about a pivot axis extending parallel to at least one of the roller axes.

6. The image forming device as claimed in claim 5, further comprising a biasing member that biases the one of the pair of conveyer rollers toward a remaining one of the pair of conveyer rollers.

7. The image forming device as claimed in claim 5, wherein the holding member is pivotally movable about the pivot axis for moving the one of the pair of conveyer rollers to either one of the first position and the second position.

8. The image forming device as claimed in claim 7, wherein the position detector comprises a photo-sensor that detects the holding member when the one of the pair of conveyer rollers supported to the holding member is at the second position.

9. The image forming device as claimed in claim 5, wherein the pair of conveyer rollers is divided into a plurality of roller sections arrayed on a respective roller axis; and wherein the holding member is divided into a plurality of holding member sections corresponding to the plurality of roller sections.

10. The image forming device as claimed in claim 1, wherein the second sheet sensor is at a fixed position relative to the pair of fixing rollers.

11. The image forming device as claimed in claim 1, wherein the second fixed position includes an imaginary plane; and wherein the second sheet sensor comprises an actuator extending along the imaginary plane.

12. The image forming device as claimed in claim 1, further comprising an alarm unit connected to the control unit, the alarm unit alarming sheet jamming when the first time period exceeds the first threshold time period or when the second time period exceeds the second threshold time period.

13. A combination of a fixing device and a sheet jamming determination device comprising:

the fixing device comprising:

a frame;

a pair of conveyer rollers including an upper roller and a lower roller;

a pair of fixing rollers rotatably supported to the frame, and positioned upstream of the pair of conveyer roller in a sheet feeding direction;

a lower holding member vertically movably supported to the frame and rotatably supporting the lower roller an upper holding member pivotally movably supported to the frame and movable to either one of a first position and a second position in synchronism with movement of the lower holding member, the upper holding member rotatably supporting the upper roller maintaining a contact of the upper roller with the lower roller; and a sheet guide section having an upstream end portion pivotally movable relative to the frame and a downstream end portion pivotally movable about an axis of the upper roller to change a posture of the sheet guide section; and the sheet jamming determination device comprising:

a position detector that detects a position of the upper holding member;

a first sheet sensor that detects passing of the sheet at a first fixed position upstream of the pair of fixing rollers in the sheet feeding direction;

a second sheet sensor that detects arrival of the sheet at a second fixed position downstream of the pair of fixing rollers in the sheet feeding direction; and a control unit to which the position detector, the first sheet sensor and the second sheet sensor are connected, the control unit comprising:

a processing unit;

a non-transitory medium, having instructions stored thereon that, when executed by the processing unit, cause the control unit ot function as a retrieving part that retrieves a first threshold time period when the position detector detects the first position of the upper holding member, or retrieves a second threshold time period different from the first threshold time period when the position detector detects the second position of the upper holding member; and a determination part that determines whether or not a first time period starting from a timing of detection by the first sheet sensor and ending at a timing of detection by the second sheet sensor is within the first threshold time period when the position detector detects the first position, or determines whether or not a second time period starting from a timing of detection by the first sheet sensor and ending at a timing of detection by the second sheet sensor is within the second threshold time period when the position detector detects the second position.

14. The combination as claimed in claim 13, wherein the control unit further comprises a storage part that stores the first threshold time period and the second threshold time period.

15. The combination as claimed in claim 13, wherein the sheet guide section extends between the pair of fixing rollers and the pair of conveyer rollers for guiding travel of the sheet fed from the pair of fixing rollers toward the pair of conveyer rollers.

16. The combination as claimed in claim 13, further comprising a biasing member that biases one of the upper roller and the lower roller toward a remaining one of the upper roller and the lower roller.

17. The combination as claimed in claim 13, wherein the second sheet sensor is at a fixed position relative to the pair of fixing rollers.

18. The combination as claimed in claim 13, wherein the second fixed position includes an imaginary plane; and wherein the second sheet sensor comprises an actuator extending along the imaginary plane.

19. The combination as claimed in claim 13, further comprising an alarm unit connected to the control unit, the alarm unit alarming sheet jamming when the first time period exceeds the first threshold time period or when the second time period exceeds the second threshold time period.

* * * * *